United States Patent [19]

Winters

[11] 4,145,984

[45] Mar. 27, 1979

[54] BOBBIN CASE RESTRAINING MEANS FOR A SEWING MACHINE

[75] Inventor: Edward E. Winters, Edison, N.J.

[73] Assignee: The Singer Company, New York, N.Y.

[21] Appl. No.: 885,063

[22] Filed: Mar. 9, 1978

[51] Int. Cl.[2] ..... D05B 57/26

[52] U.S. Cl. ..... 112/231

[58] Field of Search ..... 112/228, 231, 181, 184

[56] References Cited

U.S. PATENT DOCUMENTS

| | | | |
|---|---|---|---|
| 1,086,662 | 2/1914 | Gould | 112/181 |
| 3,049,086 | 8/1962 | Johnson | 112/228 X |
| 3,115,855 | 12/1963 | Ketterer | 112/184 |
| 3,416,472 | 12/1968 | Johnson | 112/184 |
| 3,882,805 | 5/1975 | Bianchi | 112/181 X |

*Primary Examiner*—Wm. Carter Reynolds

*Attorney, Agent, or Firm*—William V. Ebs; Robert E. Smith; Edward L. Bell

[57] ABSTRACT

A sewing machine is provided with bobbin case restraining means including a pivoted member to engage and restrict movement of the bobbin case, and including a latch for the pivoted member, the pivoted member and latch being movable into a bobbin case restraining position during movement of a bed slide plate toward a closed position.

2 Claims, 7 Drawing Figures

BOBBIN CASE RESTRAINING MEANS FOR A SEWING MACHINE

BACKGROUND OF THE INVENTION

1. Field of the Invention

The invention is directed to novel and improved mechanism for restricting movement of a bobbin case within the loop taker of a sewing machine.

2. Background of the Invention

Sewing machines are usually provided with removable bobbin cases and with mechanism which can be positioned to lock the bobbin case in place within the loop taker of the machine or disposed when desired to permit removal of the case from the loop taker for inspection. A problem is encountered with the prior art bobbin case restraining devices however, since the operator may forget or fail to properly dispose the device in the bobbin case restraining position before closing the bed slide plate of a machine and setting the machine into operation, and a thread jam may result preventing the machine from properly forming stitches.

SUMMARY OF THE INVENTION

In accordance with the invention, a sewing machine is provided with bobbin case restraining mechanism which can be manually disposed to permit removal of the case from the machine and is operable by a bed slide plate and cam means thereon effective to move the restraining mechanism into a position to restrain movement of a bobbin case in a needle loop taker when the bed slide plate of the machine is closed. Said mechanism is constructed to prevent closure of the bed slide plate whenever the bobbin case is improperly positioned within the loop taker. The operator of a machine is thereby alerted to the condition and may take corrective action.

DESCRIPTION OF THE PREFERRED EMBODIMENT

Figure 1:
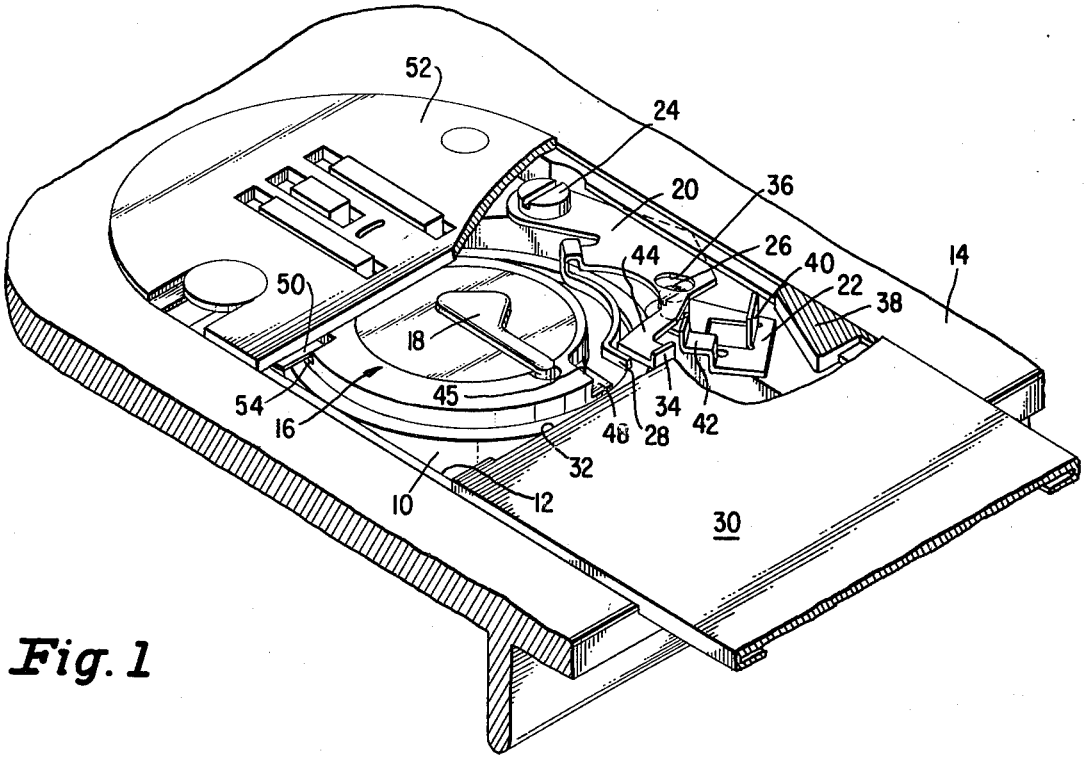
FIG. 1 is a perspective view showing mechanism according to the invention in a position permitting removal of a bobbin case from a loop taker.
Figure 2:
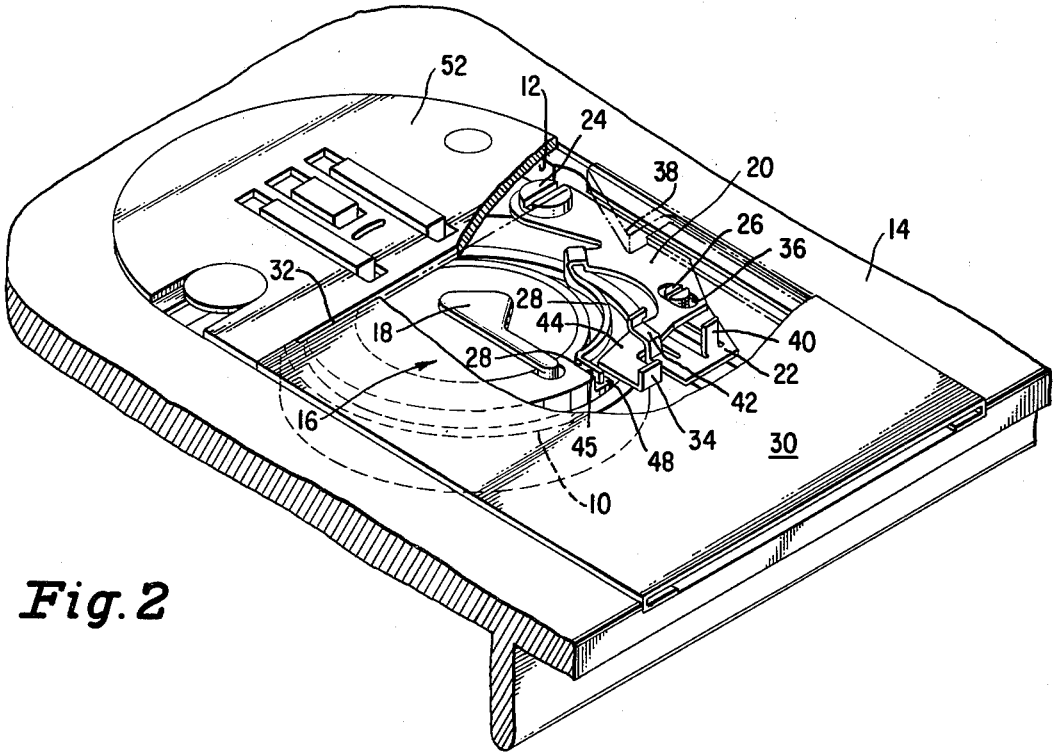
FIG. 2 is a perspective view similar to FIG. 1 showing said mechanism in a position for restraining movement of the bobbin case in said loop taker.

Referring to FIGS. 1 and 2 of the drawings, reference character 10 designates the loop taker of a sewing machine, which loop taker is shown within a cavity 12 in the bed 14 of the machine where it rotates in a counterclockwise direction as viewed in the drawing when the machine is sewing. A bobbin case 16 is shown properly positioned within the loop taker 12, that is, eccentrically situated within the periphery of the loop taker relative to the axis thereof. As shown, the bobbin case 16 is provided with a finger 18, the finger being pivotable upwardly from the top of the bobbin case for use in removing the bobbin case from the loop taker.

Bobbin case restraining means are provided according to the invention and include a pivoted bobbin case engagable member 20 of a resilient material such as spring steel and a pivoted latch 22. The member 20 and latch 22 are pivoted on screws 24 and 26 respectively affixed in the machine bed, and move thereon between the open positions of FIG. 1 permitting removal of the bobbin case from the loop taker or insertion therein, and the bobbin case holding positions of FIG. 2. The said member 20 is flexible transversely with respect to the direction in which it is pivotable about screw 24.

The FIG. 1 position of the restraining means, is attained by an operator manually moving latch 22 counterclockwise about screw 26 into the position wherein it is shown, and by both lifting member 20 and moving it counterclockwise to a position wherein it rests on the top of screw 26. With the restraining means so disposed an operator can, after having pivoted finger 18 to an upright position, easily maneuver the bobbin case 16 with the finger out of the loop taker 10 supporting it, and out of the bed cavity 12 without interference from member 20, and more particularly without interference from a spring cushion arm 28 of the member 20.

Latch 22 and member 20 can be manually manipulated into the bobbin case holding position of FIG. 2. However, it is a feature of the invention that a bed slide plate 30, which is slidable over the cavity 12, is effective, when moved to a closed position, to cause member 20 and latch 22 to move into their bobbin case holding positions. As the bed slide plate 30 is moved toward a closed position (see FIG. 1), the edge 32 of plate 30 comes into engagement with a tab 34 on the member 20 and causes the member 20 to be moved about screw 24 until an opening 36 in the member 20 is aligned with screw 26 whereupon the member flexes downwardly into its bobbin case holding position of FIG. 2. While member 20 is being moved into its bobbin case holding position, a triangular shaped cam 38 provided on the underside of plate 30 is caused to engage an upright projection 40 on latch 22 and move the latch about screw 26 until disposed in the position where it is shown in FIG. 2, that is, with a locking finger 42 thereon over an arm 44 of member 20.

In the bobbin case holding positions of member 20 and latch 22, cushion arm 28 of the member 20 is disposed for engagement with a vertical ledge 45 on the bobbin case and thereby serves to prevent rotation of the bobbin case with loop taker 10. Vertical upward movement of the bobbin case is restrained by the engagement of arm 28 with a step 48 on the bobbin case and disposition of latch locking finger 42 over member 20 of which the arm 28 is a part. Vertical upward movement of the bobbin case is additionally restrained by a tab 50 located under feed dog plate 52 in a position to overlie a step 54 on the bobbin case.

Tab 34 on member 20 is of such a height as to remain in engagement with the edge 32 of plate 30 during movement of the plate toward a closed position until the member attains its fully unflexed bobbin restraining position of FIG. 2. If the bobbin case is disposed in a cocked position or has been otherwise improperly positioned in the loop taker such as to prevent member 20 from attaining the fully unflexed position, closure of the plate 30 is prevented by engagement of the tab 34 with plate edge 32. An operator is thereby alerted to the error and can take corrective action to prevent possible damage to the machine.

It is to be understood that the present disclosure relates to a preferred embodiment of the invention which is for purposes of illustration only, and that various changes and modifications may be made therein departing from the spirit and scope of the invention as defined in the appended claims.

Having thus set forth the nature of the invention, what is claimed herein is:

1. In a sewing machine, the combination comprising a machine bed having an opening therein, a circularly movable loop taker journalled in the bed in said opening, a bobbin case supported in the loop taker, a pivoted bobbin case restraining member movable into one position for holding the bobbin case within the loop taker and preventing rotation thereof, and movable into another position permitting removal of the bobbin case from the loop taker, a removable latch, a plate slidable over said opening, and a cam on the plate, said plate being engageable with the bobbin case restraining member for causing the bobbin case restraining member to move from said another position to the bobbin case holding position and the cam being engageable with the latch for moving the latch into a locking position over the restraining member as the plate is slid over said opening in a direction to cover the loop taker, the plate being slidable in the opposite direction into a position permitting the latch to be manually moved out of its locking position and the bobbin case restraining means to be manually moved to said another position.

2. The combination of claim 1 wherein the said bobbin case restraining member is resilient and is flexible in a direction transversly relative to the direction of pivotal movement, and said member is engageable with an advancing edge of the slidable plate when disposed in an upwardly flexed position.

* * * * *